US011738580B2

(12) United States Patent
Tamaki

(10) Patent No.: US 11,738,580 B2
(45) Date of Patent: Aug. 29, 2023

(54) IMAGE RECORDING APPARATUS WITH RECIPROCATING CARRIAGE AND HAVING A GUIDE DEVICE

(71) Applicant: Brother Kogyo Kabushiki Kaisha, Nagoya (JP)

(72) Inventor: Shuichi Tamaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/265,250

(22) Filed: Apr. 29, 2014

(65) Prior Publication Data

US 2014/0232786 A1 Aug. 21, 2014

Related U.S. Application Data

(63) Continuation of application No. 11/612,892, filed on Dec. 19, 2006.

(30) Foreign Application Priority Data

Dec. 19, 2005 (JP) ..... 2005-364688

(51) Int. Cl.
*B41J 19/14* (2006.01)
*B41J 19/20* (2006.01)
*B41J 2/175* (2006.01)

(52) U.S. Cl.
CPC ..... *B41J 19/142* (2013.01); *B41J 2/17509* (2013.01); *B41J 19/207* (2013.01)

(58) Field of Classification Search
None
See application file for complete search history.

(56) References Cited

U.S. PATENT DOCUMENTS 4,580,150 A 4/1986 Tazaki
5,138,343 A 8/1992 Aichi et al.
(Continued)

FOREIGN PATENT DOCUMENTS

EP 1510350 A1 3/2005
GB 2361670 A 10/2001
(Continued)

OTHER PUBLICATIONS

European Patent Office, European Search Report for European Patent Application No. 06026104.7 (counterpart to co-pending U.S. Appl. No. 11/612,892), dated Mar. 2, 2007.
(Continued)

*Primary Examiner* — Alejandro Valencia
(74) *Attorney, Agent, or Firm* — Baker Botts L.L.P.

(57) ABSTRACT

A printer including: (i) a guide device extending in a first direction; (ii) a carriage reciprocateable in the first direction, while being guided by the guide device; (iii) a recording head carried by the carriage; (iv) a feed device for feeding the recording medium in a second direction perpendicular to the first direction; (v) a flexible ink-supply tube for supplying ink to the recording head; and (vi) a carriage movement detector including an encoder strip which extends in the first direction. The ink-supply tube has a U-shaped body including a pair of arm portions extending in the first direction and spaced apart from each other in the second direction. The guide device, the ink-supply tube and the encoder strip are located on respective different positions in a third direction that is perpendicular to the first and second directions. The ink-supply tube has a part that overlaps with the guide device and the encoder strip as seen in the third direction.

10 Claims, 8 Drawing Sheets

(56) References Cited

U.S. PATENT DOCUMENTS

| | | | | |
|---|---|---|---|---|
| 5,543,826 | A | 8/1996 | Kuronuma et al. | |
| 5,757,390 | A | 5/1998 | Gragg et al. | |
| 6,012,806 | A * | 1/2000 | de Olazabal | B41J 2/17509 347/85 |
| 6,203,139 | B1 * | 3/2001 | Beauchamp | B41J 2/2132 347/37 |
| 6,254,292 | B1 * | 7/2001 | Navarro | B41J 19/207 400/705 |
| 6,264,303 | B1 * | 7/2001 | Watanabe | B41J 19/207 347/37 |
| 6,493,937 | B1 | 12/2002 | Axtell et al. | |
| 6,779,875 | B2 | 8/2004 | Pawlowski, Jr. et al. | |
| 6,783,215 | B2 | 8/2004 | Yoshida et al. | |
| 2001/0026304 | A1 | 10/2001 | Matsuzaki et al. | |
| 2002/0097294 | A1 | 7/2002 | Shibata et al. | |
| 2003/0067506 | A1 | 4/2003 | Rotering | |
| 2004/0061757 | A1 * | 4/2004 | Yanagi et al. | 347/101 |
| 2004/0252159 | A1 * | 12/2004 | Sato | 347/37 |
| 2005/0083383 | A1 * | 4/2005 | Tsuyama | B41J 29/02 347/85 |
| 2005/0243125 | A1 * | 11/2005 | Ishikawa | 347/37 |
| 2005/0281603 | A1 * | 12/2005 | Cook | B41J 11/20 400/354 |
| 2006/0114276 | A1 * | 6/2006 | Ohashi | B41J 2/17546 347/5 |

FOREIGN PATENT DOCUMENTS

| | | | |
|---|---|---|---|
| JP | H11-132788 | A | 5/1999 |
| JP | 2001-121721 | A | 5/2001 |
| JP | 2001-270132 | A | 10/2001 |
| JP | 2004-175072 | A | 6/2004 |
| JP | 2004-230802 | A | 8/2004 |
| WO | 99/47356 | A1 | 9/1999 |

OTHER PUBLICATIONS

Japan Patent Office, Notification of Reason for Refusal for Japanese Patent Application No. 2005-364688 (counterpart to co-pending U.S. Appl. No. 11/612,892), dated Feb. 22, 2011.

* cited by examiner

IMAGE RECORDING APPARATUS WITH RECIPROCATING CARRIAGE AND HAVING A GUIDE DEVICE

CROSS-REFERENCE TO RELATED APPLICATIONS

The present application is a continuation of and claims the benefit of pending U.S. patent application Ser. No. 11/612,892 filed on Dec. 19, 2006, which is based on Japanese Patent Application No. 2005-364688 filed on Dec. 19, 2005. The contents of each of the above documents are hereby incorporated by reference in their entirety.

BACKGROUND OF THE INVENTION

1. Field of the Invention

The present invention relates to a printer including a guide device, a carriage, a recording head, an ink-supply tube, and an encoder strip.

2. Discussion of Related Art

There is known an image recording apparatus which records an image on a recording medium by ejecting ink to the recording medium based on an input signal, in particular, by introducing the ink to a recording head including an actuator such as a piezoelectric element, an electrostriction element and a heating element, so as to give pressure the ink to eject by utilizing a deformation of the piezoelectric element or the electrostriction element based on the input signal or a partial boiling of the ink by the heating element.

For example, the image recording apparatus called a "serial printer" includes the recording head carried by a carriage which is reciprocateable in a direction perpendicular to a direction of feeding a recording sheet as a recording medium (a sheet-feed direction). The recording head is reciprocated together with the carriage after each time the recording sheet is fed by an amount corresponding to a line feed amount, and ejects the ink to the recording sheet so as to form an image on the recording sheet. The carriage is reciprocated by a drive force applied from a carriage drive device including a belt drive mechanism. A resolution of the image recording by the image recording apparatus is, for example, approximately from 300 dpi to 2400 dpi, so the reciprocating movement of the carriage should be controlled with high accuracy. As one example of the control of the carriage, Patent Document 1 (JP-A-11-132788) and Patent Document 2 (JP-A-2004-230802) discloses that the carriage is controlled based on a position of the carriage detected by a linear encoder as a kind of a carriage movement detector. The linear encoder is arranged to output a pulse signal when sensible portions of an encoder strip thereof are sensed by an optical sensor fixed to the carriage.

As disclosed in Patent Document 3 (JP-A-2001-121721), when the above-mentioned recording head ejects ink, a part of the ejected ink becomes a tiny mist-like ink (hereinafter referred to as an "ink mist") and floats in a space in the image recording apparatus. The ink mist sticks to the encoder strip of the linear encoder and thereby influences the sensing of the sensible portions by the optical sensor, causing to lower the accuracy of a position detection of the carriage by the linear encoder.

There is provided a guide device (including a guide element such as a guide shaft and a guide rail) for supporting the above-described carriage and guiding the reciprocating movement of the carriage. The guide device has a slide surface on which the carriage reciprocates. A lubricant such as grease is spread on the slide surface such that the carriage can reciprocate smoothly. For example, during an operation for recovering from a trouble such as paper jam, an operator may contact the encoder strip, thereby the encoder strip is bent. Accordingly, the encoder strip contacts the slide surface of the guide device, causing that the lubricant on the slide surface is stuck to the encoder strip. Some lubricant is transparent, but dust is easily stuck to the lubricant because of its viscosity. The encoder strip becomes dirty with the dust stuck thereto via the lubricant, causing the sensible portions (of the encoder strip) to be undetectable by the optical sensor, and accordingly lower the accuracy of the position detection of the carriage.

There is one example of a recording head which is carried by the carriage and which supplies ink via an ink tube from an ink cartridge. The ink tube has a length so as to follow the reciprocating movement of the carriage without preventing said movement of the carriage. The ink tube is bent in a generally U-shape in a space between the carriage and a main body of the image recording apparatus. The ink tube has a flexibility enabling the U-shape of the ink tube to be changed by the reciprocating movement of the carriage, so as to follow the movement of the carriage. At the time, the ink tube is shaken so as to contact the slide surface of the guide device and the encoder strip, so that the lubricant applied on the guide device could be stuck to the encoder strip, possibly reducing the accuracy in detecting the position of the carriage. In a case where a space allowing change in attitude of the ink tube is provided in a position that is distant from the guide device and the encoder strip in order to prevent the ink tube from contacting the guide device and the encoder strip, the apparatus needs a larger space inside, contrary to the expectation for downsizing the apparatus.

SUMMARY OF THE INVENTION

In the light of the above-described technical background, the present invention has been developed. It is therefore an object of the present invention to solve the above-indicated problem and to provide a printer having arrangements for enjoying a reduced size and preventing an encoder strip of a carriage movement detector from becoming dirty by a lubricant and so on.

According to a first aspect of the present invention, there is provided a printer comprising: a guide device which extends in a first direction that is a horizontal direction; a carriage which is reciprocateable in the first direction, while being supported and guided by the guide device; a recording head which is carried by the carriage, and which ejects droplets of ink toward a recording medium so as to record an image thereon; a medium-feed device which feeds the recording medium along a medium-feed path including a recording-stage portion which extends in a second direction perpendicular to the first direction and in which the fed recording medium is opposed to a movement path of the recording head that is defined by a reciprocating movement of the carriage; a flexible ink-supply tube which supplies ink to the recording head, the ink-supply tube being curved in a generally U-shape as seen in a third direction that is a substantially vertical direction perpendicular to the first and the second directions, so as to have a U-shaped body including a pair of arm portions which extend substantially in the first direction and which are spaced apart from each other in the second direction, the U-shape of the U-shaped body being changed such that one and the other of the pair of arm portions of the body are made larger and smaller in length, respectively, by the reciprocating movement of the carriage; and a carriage movement detector including (a) a sensor which is carried by the carriage and (b) an encoder strip which extends in the first direction and which has sensible portions arranged in a lengthwise direction thereof and sensible by the sensor, such that the reciprocating movement of the carriage is detected based on sensing of the sensible portions by the sensor, wherein the guide device, the ink-supply tube and the encoder strip are located on respective different positions in the third direction, and wherein the ink-supply tube has a part overlapping with the guide device and the encoder strip as seen in the third direction.

In the present printer, the guide device, the ink-supply tube and the encoder strip are located on respective different positions in the third direction. A lubricant such as grease is spread on the guide device for a smooth sliding of the carriage. In a case in which the encoder strip contacts the guide device, the encoder strip may be soiled with the lubricant, so that the sensible portions of the encoder strip could not sensed by the sensor. In the present printer, since the guide device, the ink-supply tube and the encoder strip are located on respective different positions in the third direction, the encoder strip is prevented from contacting the guide device. Therefore, the encoder strip can be accurately sensed by the sensor and the reciprocating movement of the carriage is controlled with high stability.

Also, the ink-supply tube has a flexibility, and the U-shape of the U-shaped body thereof is changeable so as to follow the reciprocating movement of the carriage. The ink-supply tube is partially aligned or overlaps with the guide device and the encoder strip as seen in the third direction. Thus, the present printer can enjoy a reduced size, compared to an arrangement in which the ink-supply tube does not overlap at all with the guide device and the encoder strip as seen in the third direction, namely, an arrangement in which a space for accommodating a part of the ink-supply tube located somewhere else where other members of the printer such as the guide device and the encoder strip are not located as seen in the third direction. When the U-shape of the U-shaped body is changed by the reciprocating movement of the carriage, the ink tube can be shaken in the horizontal direction. In the present printer, since the guide device, the ink-supply tube and the encoder strip are located on respective different positions in the third direction (i.e., vertical direction), the ink-supply tube does not contact the guide device and the encoder strip. Therefore, the encoder strip is prevented the lubricant applied on the guide device from being stuck thereto via the ink-supply tube.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. It is noted that each of terms "vertical direction" and "horizontal direction" used in the following description does no have to be necessarily interpreted to mean a precisely vertical or horizontal direction but may be interpreted to mean a substantially vertical or horizontal direction that is inclined with respect to the precisely vertical or horizontal direction by a certain degree of, for example, not larger than 15 degrees.

Figure 1:
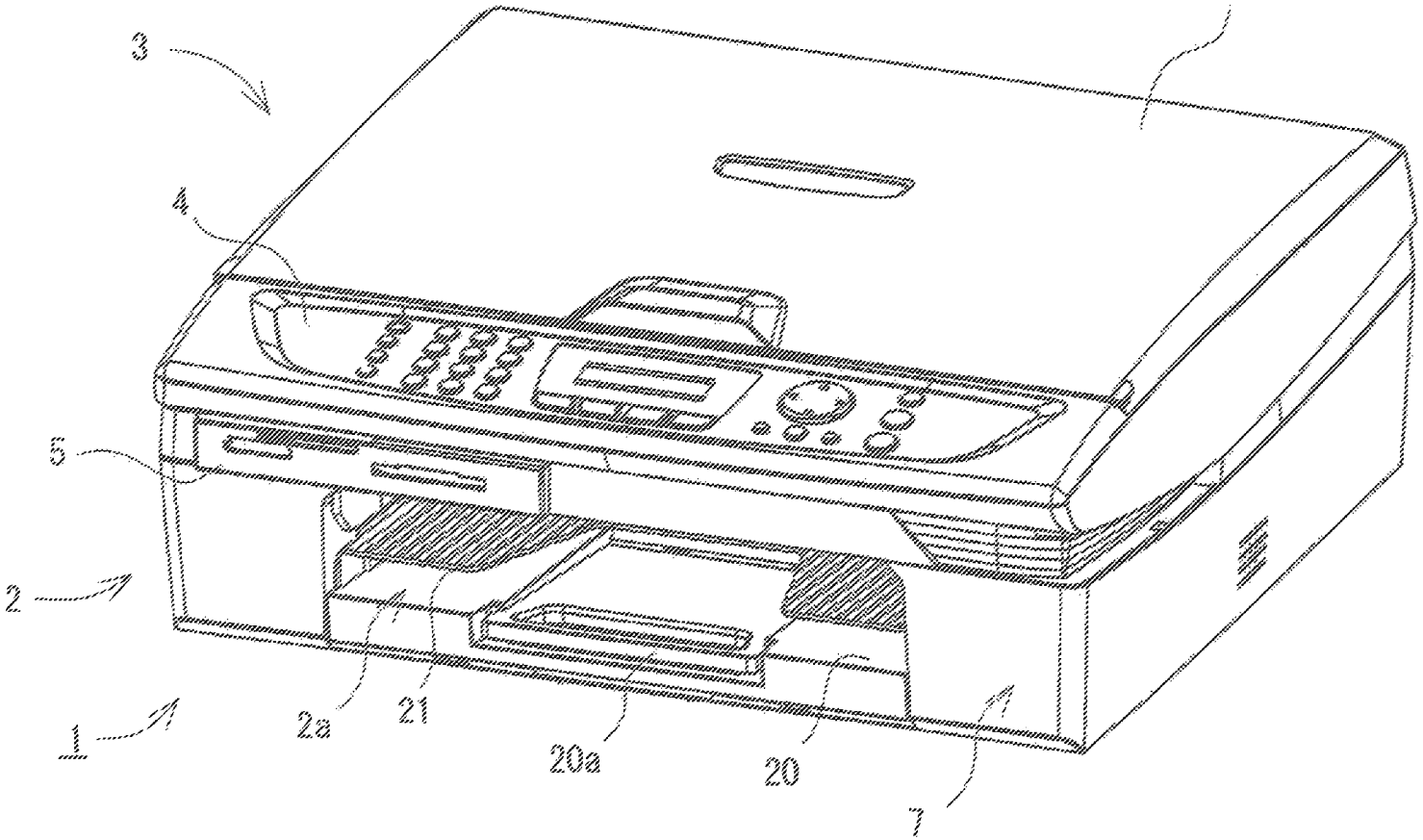
FIG. 1 is a perspective view of a multi-function device (MFD) to which the present invention is applied.

FIG. 1 shows an appearance of a "multi-function device (MFD)" 1 as one embodiment of the present invention. The MFD 1 has a printer function, a scanner function, a copier function and a facsimile-machine function, and includes a printer portion 2 provided in a lower portion thereof, and a scanner portion 3 provided in an upper portion thereof that is integral with the lower portion. In the present embodiment, the multi-function device 1 includes a printer portion 2 as the printer to which the present invention is applied. The functions other than the printer function may be omitted, that is, the scanner portion 3 may be omitted. Thus, the present invention may be applied to a single-function printer that has only the printer function and does not have the scanner, copier or facsimile-machine function.

The printer portion 2 of the MFD 1 is mainly connected to an external data-processor device such as a computer, not shown, so that the MFD 1 can record, based on record data including image data and script data supplied from the computer, an image or a script on a recording sheet as the recording medium. Alternatively, the MFD 1 may be connected to a digital camera, so that the MFD 1 may record, based on image data outputted from the digital camera, an image on a recording sheet. Moreover, the MFD 1 may include a memory receiving portion that can receive each of various sorts of memories, such as a memory card, so that the MFD 1 may record, based on image data stored in the each memory, an image on a recording sheet.

Figure 2:
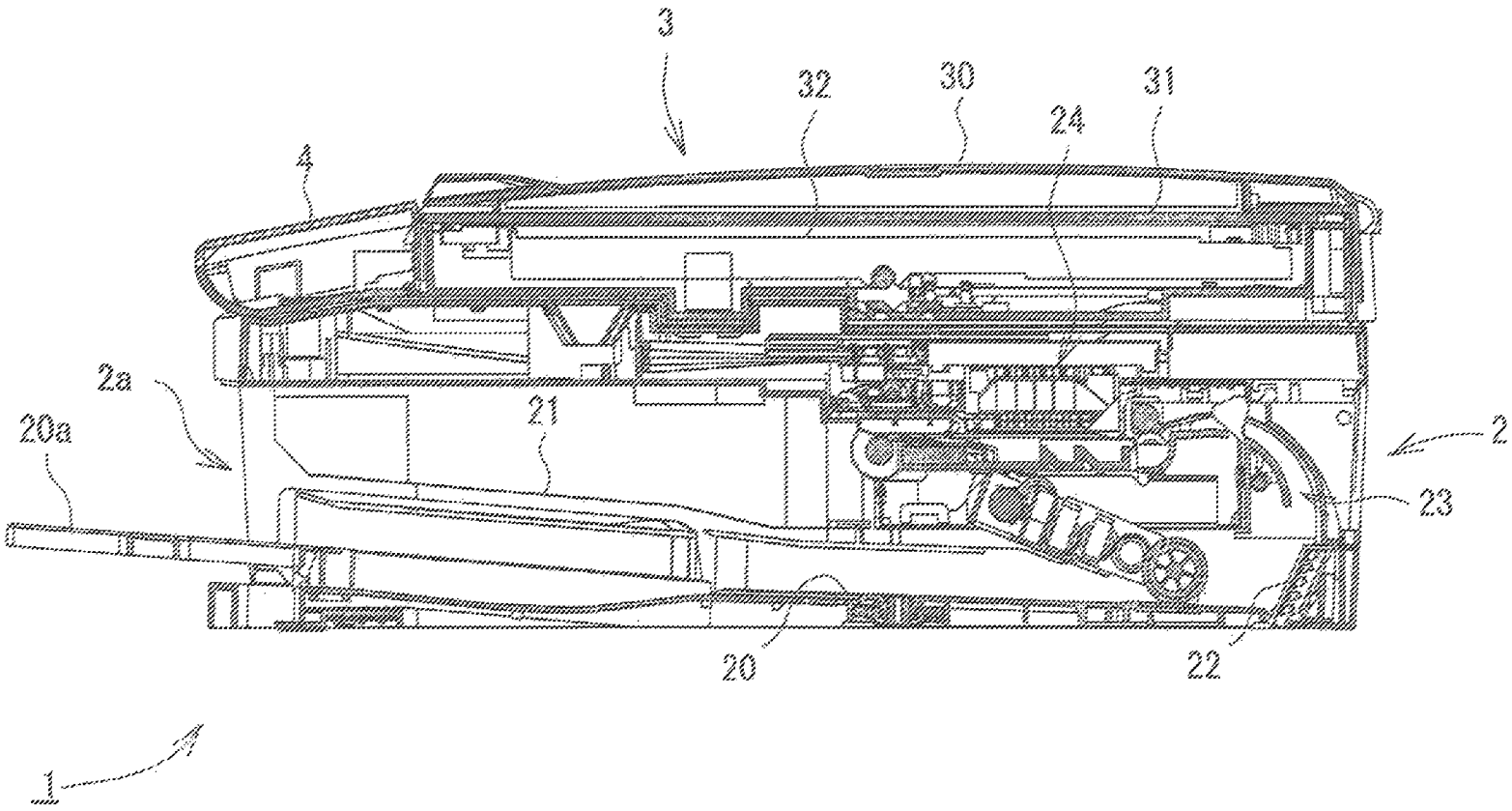
FIG. 2 is a cross-sectional view showing an internal structure of the MFD.

As shown in FIG. 1, a width and a length of the MFD 1 are greater than a height thereof. Thus, the MFD 1 has a generally rectangular parallelepiped shape. The printer portion 2 is provided in the lower portion of the MFD 1. The printer portion 2 includes a front opening 2*a* formed in a front surface of the MFD 1, and a sheet-feed tray 20 and a sheet-discharge tray 21 that are exposed through the front opening 2*a* and that have a stacked structure. The sheet-feed tray 20 is for storing the recording sheets as recording media, and can accommodate sheets of various sizes not larger than A4 Size, such as A4 Size, B5 Size, or Postcard Size. As shown in FIG. 2, the sheet-feed tray 20 includes a slide member 20*a* that can be extended, as needed, to increase a sheet-support surface of the tray 20 and that can accommodate sheets of larger sizes such as Legal Size. The recording sheets accommodated by the sheet-feed tray 20 are supplied, one by one, to an inside of the printer portion 2, so that after a desired image is recorded on each recording sheet, the each sheet is discharged onto the sheet-discharge tray 21.

The scanner portion 3, i.e., so-called "flat-bed" scanner is provided in the upper portion of the MFD 1. As shown in FIGS. 1 and 2, the scanner portion 3 includes a cover member 30 as a top plate that can cover an original sheet placed on an upper surface of a platen glass 31. The cover member 30 is pivotable upward and downward so as to be opened and closed. An image sensor 32 is provided below the platen glass 31. The original sheet has an original image to be read by the scanner portion 3. A main scanning direction in which the image sensor 32 is moved to read the original image from the original sheet is a lengthwise direction of the MFD 1 (leftward and rightward directions in FIG. 2). The image sensor 32 is reciprocateable in a widthwise direction of the MFD 1 (a direction perpendicular to a sheet plane of FIG. 2).

An operation panel 4 is provided in a front end portion of the upper portion of the MFD 1. The operation panel 4 is for operating the printer portion 2 and the scanner portion 3. The operation panel 4 includes various operation keys and a liquid crystal display (LCD) that are used by a user to input various commands to operate the MFD 1. In the case where the MFD 1 is connected to the above-described computer, the MFD 1 is operated according to commands supplied from the computer via a printer driver or a scanner driver. The MFD 1 has, in a left, top portion of the front surface thereof (FIG. 1), a slot portion 5 in which each of various sorts of small-size memory cards each as a data memory can be inserted, and the MFD 1 can read image data stored by the each memory card so that based on the thus read image data, images may be displayed by the LCD of the operation panel 4. The user of the MFD 1 can select, by operating the keys of the operation panel 4, one or more desired images from the images displayed on the LCD, so that the printer portion 2 may record the images on the recording sheets, respectively.

Figure 3:
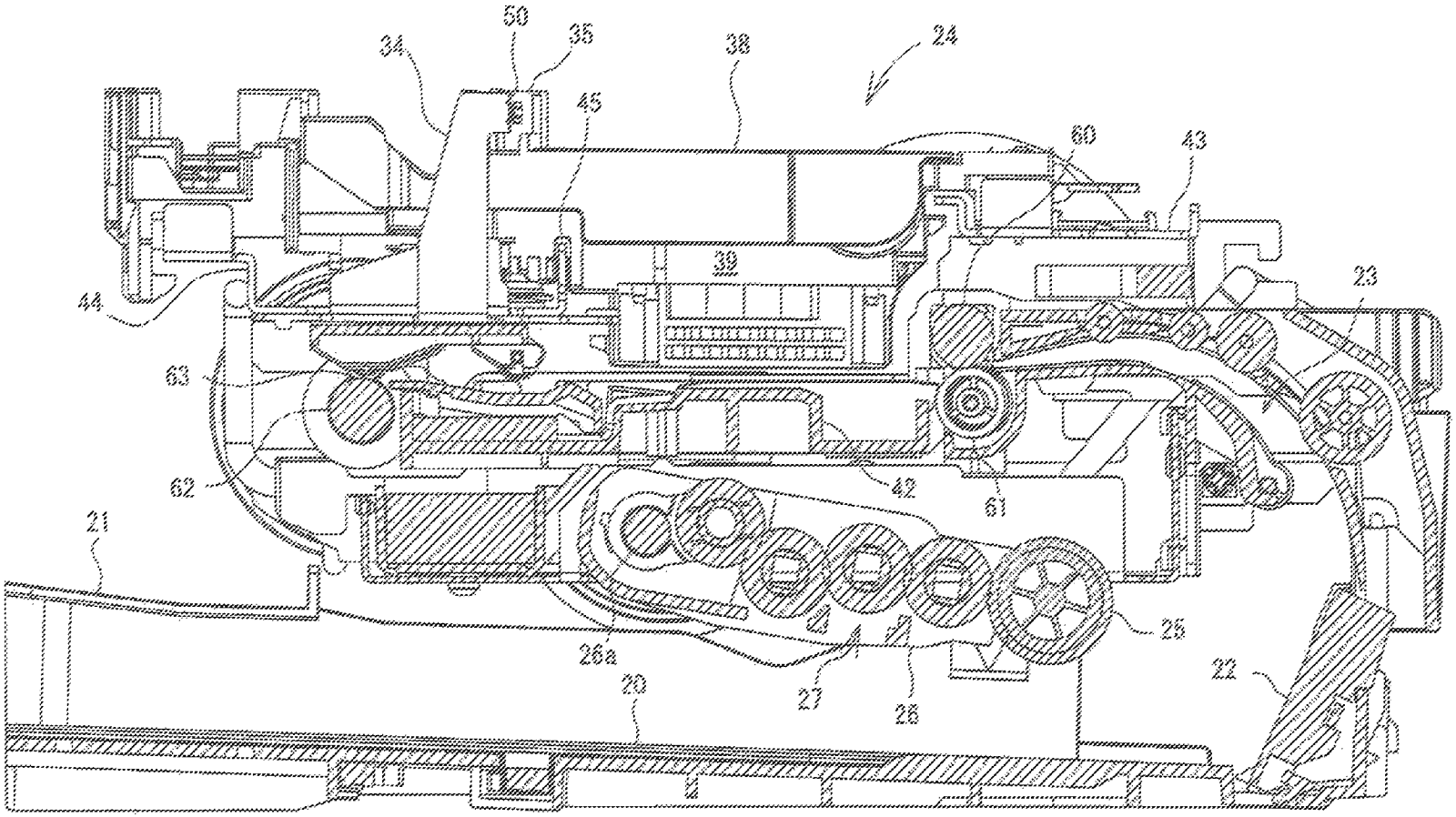
FIG. 3 is an enlarged, cross-sectional view of a printer portion of the MFD.

Hereinafter, there will be described an internal construction of the MFD 1, especially a construction of the printer portion 2, by reference to FIGS. 2 through 8. As shown in FIG. 2, the sheet-feed tray 20 is provided in a bottom portion of the MFD 1 and the sheet-feed tray 20 has an inclined sheet-separate plate 22 provided in a downstream-side end portion thereof with respect to a sheet-feed direction as the second direction in which each recording sheet is supplied from the tray 20. The inclined sheet-separate plate 22 is for separating each of the recording sheets stacked on the sheet-feed tray 20, from the other recording sheets, and guiding a movement of the each separated recording sheet in an upward direction toward a sheet-feed path 23. As shown in FIG. 3, the sheet-feed path 23 first extends upward, then curves toward the front side (i.e., left side in the figure) of the MFD 1, and further extends to the front opening 13. That is, the sheet-feed path 23 extends from the rear side of the MFD 1 toward the front side thereof via an image recording portion 24 and the sheet-discharge tray 21. Thus, the sheet-feed path 23 includes a U-turn portion through which the direction of feeding of each recording sheet is changed from the rearward direction to the frontward direction before the each recording sheet is fed to the image recording portion 24. After the image recording portion 24 records the image on the each recording sheet, the each sheet is discharged onto the sheet-discharge tray 21.

As shown in FIG. 3, a sheet-feed roller 25 is provided above the sheet-feed tray 20. The sheet-feed roller 25 cooperates with the inclined sheet-separate plate 22 to separate each of the recording sheets stacked on the sheet-feed tray 20, from the other recording sheets, and supply the thus separated recording sheet to the sheet-feed path 23. The sheet-feed roller 25 is rotatably supported by a lower or distal end portion of a sheet-feed arm 26 that is pivotable upward and downward so as to be movable away from and toward the sheet-feed tray 20. The sheet-feed arm 26 supports a power transmission device 27 that includes a plurality of gears meshed with each other and that is connected, at one end thereof, to the sheet-feed roller 25. When a LF (line feed) motor 71 (shown in FIG. 7) that is connected to the other end of the power transmission device 27 is driven or rotated, a driving power of the motor is transmitted to the sheet-feed roller 25 via the transmission device 27, so that the roller 25 is rotated to move each recording sheet toward the inclined sheet-separate plate 22.

Figure 4:
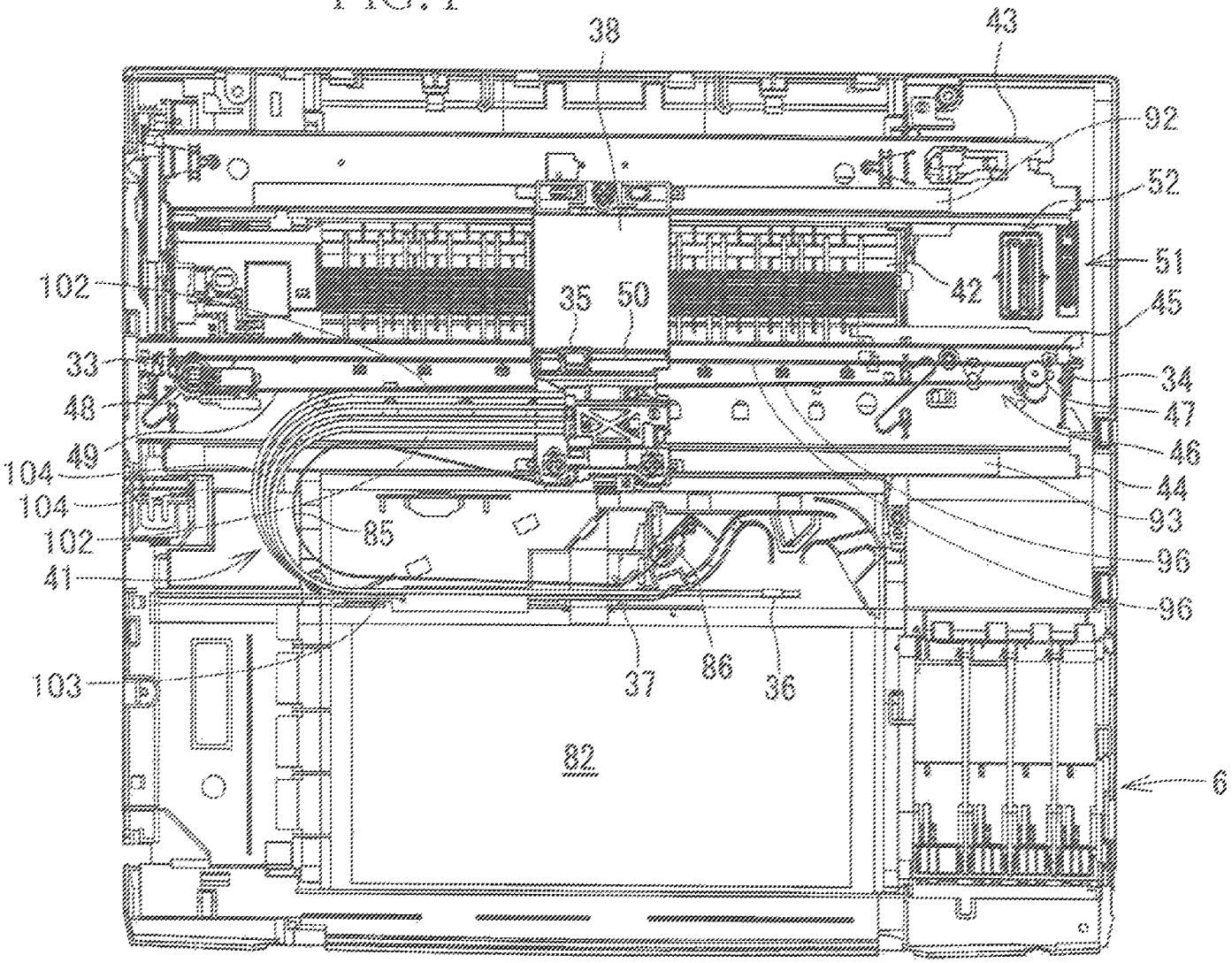
FIG. 4 is a plan view showing a pertinent structure of an image recording portion of the MFD.

As shown in FIG. 3, the image recording portion 24 is provided on a downstream side of the above-described U-turn portion of the sheet-feed path 23. As shown in FIGS. 3 and 4, the image recording portion 24 includes an ink-jet recording head 39 and an carriage 38 that carries the recording head 39 and that can be moved or reciprocated in the main scanning direction as the first direction. The sheet-feed path 23 also includes a recording-stage portion which extends in the sheet-feed direction and in which the fed recording sheet is opposed to a movement path of the recording head 39 that is defined by a reciprocating movement of the carriage 38. Four ink cartridges are provided in the MFD 1, independently of the recording head 39. Four ink cartridges store a cyan ink (C), a magenta ink (M), a yellow ink (Y), and a black ink (K), respectively, and supply those inks to the ink-jet recording head 39 via respective ink-supply tubes 41. A platen 42 is opposed to the ink-jet recording head 39. While the head 39 is reciprocated along the predetermined movement path, in the main scanning direction, the ink-jet recording head 39 selectively ejects tiny droplets of the inks toward each recording sheet being fed onto the platen 42. Thus, a desired image is recorded on the recording sheet. The ink cartridges are omitted in FIGS. 3 and 4.

As shown in FIG. 4, the MFD 1 has, in the inner space of a frame or a casing of the printer portion 2, a pair of guide rails 43, 44 as the pair of guide members each as a part of a frame that supports members constituting the printer portion 2. The two guide rails 43, 44 are provided above the sheet-feed path 23 and distant from each other by an appropriate distance in the sheet-feed direction as the second direction (i.e., the vertical direction as seen in FIG. 4) perpendicular to the first direction, and extend in parallel with each other and in a direction perpendicular to the sheet-feed direction as the first direction (in leftward and rightward directions in FIG. 4). The ink-jet recording head 39 is mounted on the carriage 38, and the carriage 38 straddles the two guide rails 43, 44 in the sheet-feed direction such that the carriage 38 is slidable in the direction perpendicular to the sheet-feed direction or in the widthwise direction of the MFD 1. Since the pair of guide rails 43, 44 lie on a generally horizontal plane including the sheet-feed direction, the printer portion 2 and the MFD 1 can be made small in height. Each of the first and the second directions is a horizontal direction.

The guide rail 43 has, which is provided on an upstream portion in the sheet-feed direction, an elongate, flat structure so that a length thereof measured in the widthwise direction of the sheet-feed path 23 (in the leftward and rightward directions in FIG. 4) is larger than a length of a range of the reciprocating movement of the carriage 38. An upstream slide portion 90 of the carriage 38 in the sheet-feed direction is mounted on a slide surface (an upper surface) 92 of the guide rail 43, while a downstream slide portion 91 of the carriage 38 is mounted on a slide surface (an upper surface) 93 of the guide rail 44, such that the carriage 38 is supported and guided by the two guide rails 43, 44 to slide in a lengthwise direction of the guide rails 43, 44. The slide surfaces 92, 93 lie on a horizontal plane. An engaged portion 45 is provided by an upstream end portion of the guide rail 44 in the sheet-feed direction that is bent perpendicularly and upwardly. The carriage 38 which is supported by the guide rails 43, 44 slidably engages at an engaging portion 94 thereof with the engaged portion 45. The engaging portion 94 includes pinch members such as a pair of rollers cooperating with each other to grip the engaged portion 45. Thus, the carriage 38 is prevented from being displaced in the sheet-feed direction, while being slidably movable in the direction perpendicular to the sheet-feed direction. That is, the carriage 38 is slidably supported on the two guide rails 43, 44 and reciprocateable in the direction perpendicular to the sheet-feed direction. On the slide surfaces 92, 93 of the guide rails 43, 44, respectively, and the engaged portion 45, a lubricant such as grease are spread for a smooth sliding of the carriage 38. It is noted that the engaging portion 94 engages the engaged portion 45 such that the carriage 38 is separable in a direction away from the slide surfaces 92, 93.

A carriage drive device 46 is provided on the upper surface of the guide rail 44. The carriage drive device 46 includes a driving pulley 47 and a driven pulley 48 which are provided adjacent to respective ends of the guide rail 44 in the widthwise direction of the sheet-feed path 23, and an endless timing belt 49 as the transmission member which is wound on the pulleys and connected at one of a pair of linear portions 96 thereof to the carriage 38. The timing belt 49 has a plurality of teeth formed on its inner surface. The linear portions 96 of the timing belt 49 extend in the widthwise direction of the sheet-feed path 23. The driving pulley 47 (at a shaft portion thereof) is driven by a carriage (CR) motor 73 (shown in FIG. 7). When the driving pulley 47 is drive, the timing belt 49 is driven or circulated. A timing belt, instead of the endless one, may have ends to which the carriage 38 is connected.

The carriage 38 is connected at a bottom thereof to the linear portion 96 of the timing belt 49. Thus, when the timing belt 49 is driven or circulated, the carriage 38 is reciprocated on the two guide rails 43, 44 while being guided by the engaged portion 45. That is, the recording head 39 carried by the carriage 38 is moved in the main scanning direction or in the widthwise direction of the sheet-feed path 23 while being supported by the two guide rails 43, 44.

Figure 7:
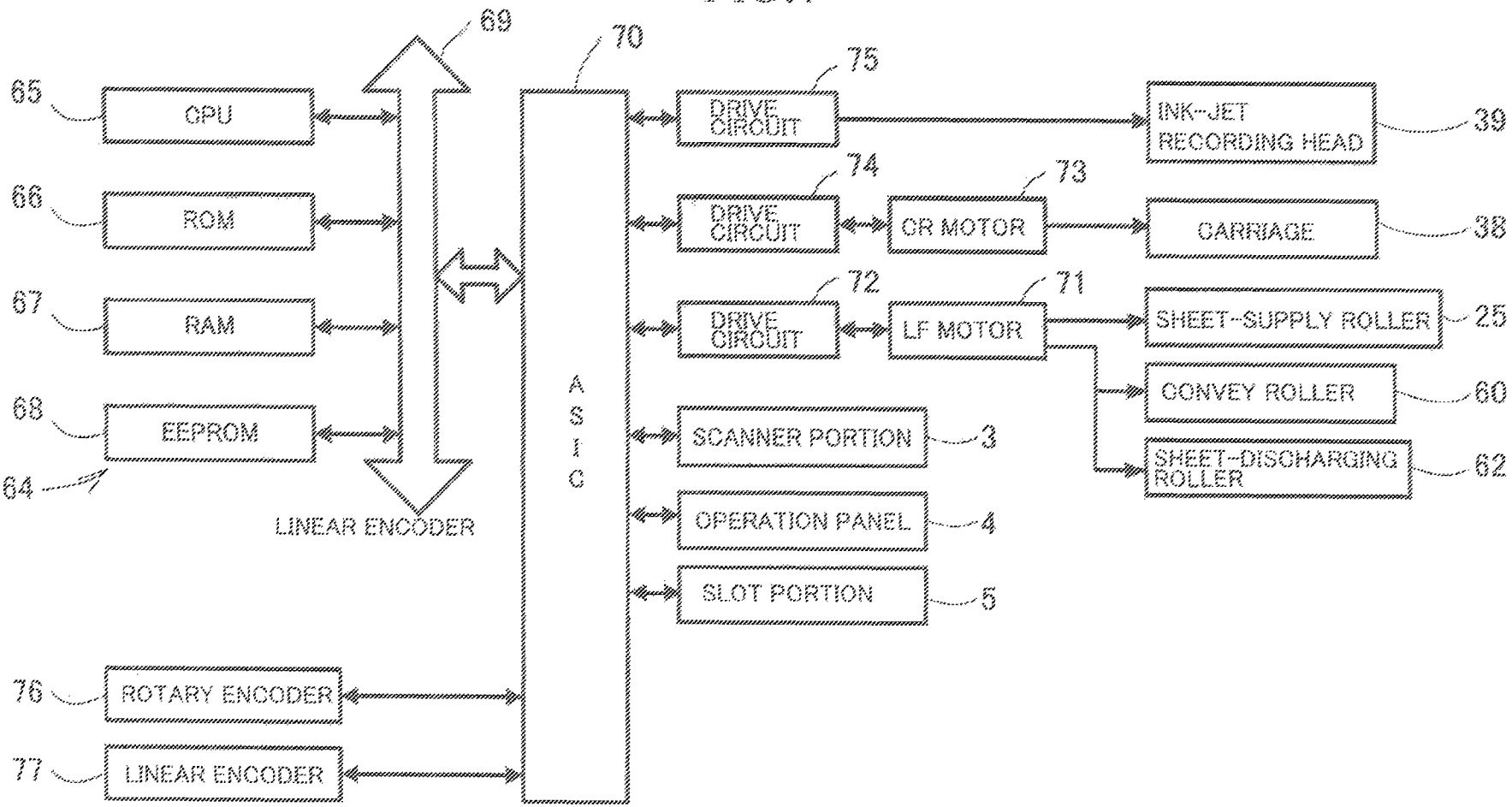
FIG. 7 is a block diagram illustrating a structure of a control portion of the MFD.
Figure 8:
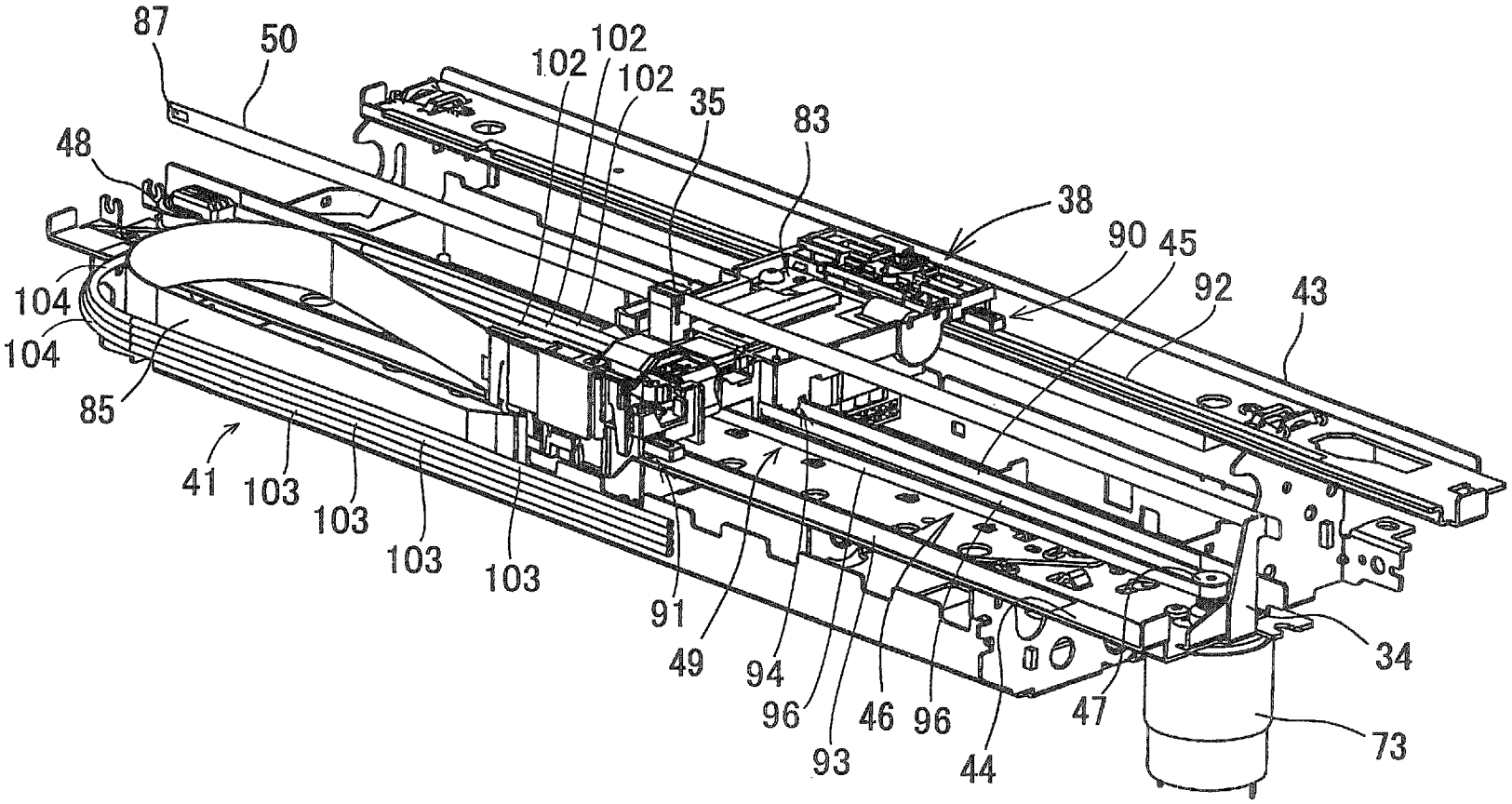
FIG. 8 is a partly perspective view showing a positional relationship between a carriage, ink tubes, and a pair of guide rails, and an engaged portion that are provided in the MFD.

As shown in FIGS. 4 and 8, there is provided an encoder strip 50 of a linear encoder 77 (shown in FIG. 7) as a kind of the carriage movement detector located between the two guide rails 43, 44 in the sheet-feed direction. The encoder strip 50 extends in the widthwise direction of the sheet-feed path 23. There are provided two support portions 33, 34 on respective ends of the guide rail 44 in the lengthwise direction thereof or in the widthwise direction (in the reciprocating direction of the carriage 38) so as to stand up from the upper surface of the guide rail 44. The encoder strip 50 is engaged with the two support portions 33, 34 at respective end portions thereof and supported by the same 33, 34, extending along the engaged portion 45. There is provided a spring (not shown) on one of the two support portions 33, 34 for engaging one of the respective end portions of the encoder strip 50. Owing to the spring, a tension is applied to the encoder strip 50 in a lengthwise direction thereof so as to prevent the encoder strip 50 from being slack. Also, in a case in which an external force acts on the encoder strip 50, the spring is elastically deformed so that the encoder strip 50 is bent.

The encoder strip 50 includes translucent portions as the sensible portions and shielding portions as the non-sensible portions alternately arranged at a predetermined distance in the lengthwise direction of the same 50. There is an optical sensor 35 of transmission type which is disposed on an upper surface of the carriage 38 so as to oppose to the encoder strip 50. The optical sensor 35 is reciprocateable along with the carriage 38 in the lengthwise direction of the encoder strip 50 for sensing the sensible portions of the encoder strip 50. As shown in FIG. 8, there is provided a head control board 83 in the recording head 39 for controlling the ink ejection by the recording head 39. The head control board 83 outputs pulse signals based on detection signals produced by the optical sensor 35. Based on the thus outputted pulse signals, a position of the carriage 38 is detected (determined), so that the reciprocating movement of the carriage 38 can be controlled. In the present embodiment, the linear encoder 77 constitutes a carriage movement detector operable to detect the reciprocating movement of the carriage 38.

As shown in FIGS. 3 and 4, below the sheet-feed path 23, the platen 42 is opposed to the ink-jet recording head 39. The platen 42 extends over a middle or central portion of the stroke range of reciprocating movement of the carriage 38, i.e., a portion of the stroke range through which the recording sheets pass. Since a width of the platen 42 as measured in the widthwise direction of the sheet-feed path 23 is larger than a maximum width of the recording sheets which can be conveyed, both sides of each recording sheet can pass on the platen 42.

As shown in FIG. 4, there is provided a cartridge mounting portion 6 or a cartridge accommodating portion 6 on a front portion of the printer portion 2 and a right-hand side in FIG. 4. As shown in FIG. 1, a door 7 is provided on a front surface (a front side) of the casing of the printer portion 2. The door 7 is pivotable so as to be opened and closed. When the door 7 is opened, the cartridge mounting portion 6 is exposed to an exterior of the MFD and ink cartridges can be mounted on or detached from the cartridge mounting portion 6. The cartridge mounting portion 6 has four accommodating portions which accommodate four ink cartridges storing black (B), cyan (C), magenta (M), and yellow (Y) inks, respectively. The ink cartridges are connected to the carriage 38 via respective four ink-supply tubes 41 corresponding to the four inks. The inks are supplied to the recording head 39 carried by the carriage 38 from the ink cartridges mounted on the cartridge mounting portion 6 via the respective ink-supply tubes 41.

Each ink-supply tube 41 is formed of a synthetic resin and has a flexibility to be bent so as to follow the reciprocating movement of the carriage 38. One end portion of the ink-supply tube 41 is attached to the cartridge mounting portion 6, while the other end portion thereof is attached to the carriage 38 (recording head 39). The ink-supply tubes 41 extend from the cartridge mounting portion 6 in the widthwise direction of the MFD 1. The ink-supply tubes 41 are attached or fixed to the frame of the MFD 1 by a fixing clip 36. The ink-supply tubes 41 are not attached to the frame or the MFD 1 at portions thereof provided between the fixing clip 36 and the carriage 38. The portions of the ink-supply tubes 41 disposed between the cartridge mounting portion 6 and the fixing clip 36 are omitted in FIG. 4.

As shown in FIG. 4, the ink-supply tubes 41 disposed between the fixing clip 36 and the carriage 38 are curved in a generally U-shape in its plan view or as seen in a vertical direction as the third direction. In the printer portion 2, there is provided a guide wall 37 extending in the widthwise direction of the MFD 1 (in the leftward and rightward directions or horizontal direction in FIG. 4), opposed to the ink-supply tubes 41. The four ink-supply tubes 41 are attached to the frame by the fixing clip 36 at their end portions (i.e., arm portions 103) which are stacked on each other in the vertical direction and which extend in the widthwise direction along the guide wall 37. The guide wall 37 prevents the ink-supply tubes 41 from protruding toward the front side of the MFD 1. The four ink-supply tubes 41 are bent and twisted in a space between the guide wall 37 and the carriage 38, such that the other end portions (i.e., arm portions 102) attached to respective attached portions of the carriage 38 are arranged, side by side, in the horizontal direction, and such that the other end portions extend from the respective attached portions of the carriage 38 in the width direction of the MFD 1. That is, each ink-supply tube 41 is curved in a generally U-shape as seen in the vertical direction, so as to have a U-shaped body including a pair of arm portions 102, 103 and a curved portion 104 located between the arm portions 102, 103. The pair of arm portions 102, 103 extend generally in the widthwise direction of the MFD 1, and are spaced apart from each other generally in the sheet-feed direction. The arm portion 102 located on the upstream side of the arm portion 103 in the sheet-feed direction tends to protrude outward (upward in FIG. 4) because they are not guided by a guide member such as the guide wall 37. It is noted that the above-described end portions of the ink-supply tubes 41 (i.e., arm portions 103 at which the tubes 41 are connected to the frame) do not have to be necessarily stacked on each other without any spacing therebetween but may be arranged with some spacing therebetween in the vertical direction. Further, in the present embodiment, the above-described other end portions of the ink-supply tubes 41 (i.e., arm portions 102 at which the tubes 41 are connected to the carriage 38) are arranged in the horizontal direction such that all of the other end portions of the tube 41 are located between a horizontal plane that is held in contact with an upper end of the uppermost one of the end portions of the tube 41 (i.e., arm portions 103 at which the tubes 41 are connected to the frame) and another horizontal plane that is held in contact with a lower end of the lowermost one of the end portions of the tubes 41 (i.e., arm portions 103 at which the tubes 41 are connected to the frame). However, the above-described other end portions of the ink-supply tubes 41 may be arranged in a direction that is inclined with respect to the horizontal direction, as long as all of the other end portions of the tubes 41 are located between the above-described two planes.

The curved shape of each ink-supply tube 41 is changed such that one and the other of the pair of arm portions 102, 103 of the body are made larger and smaller in length, respectively, by the reciprocating movement of the carriage 38. Therefore, the four ink-supply tubes 41 can follow the reciprocating movement of the carriage 38 as the curved shape is changed. As the carriage 38 is moved toward one end (a left-hand side in FIG. 4) in the widthwise direction of the MFD 1, the arm portion 102 is made smaller in length while the arm portion 103 is made larger in length. Thus, since the arm portion 102 becomes difficult to be bent, the curved portion 104 is bent such that a radius of curvature thereof becomes smaller. As the carriage 38 is moved toward the other end (a right-hand side in FIG. 4) in the widthwise direction, the arm portion 102 is made larger in length while the arm portion 103 is made smaller in length. Thus, since the arm portion 102 can be easily bent, the curved portion 104 is bent such that the radius of curvature thereof becomes larger.

Figure 5:
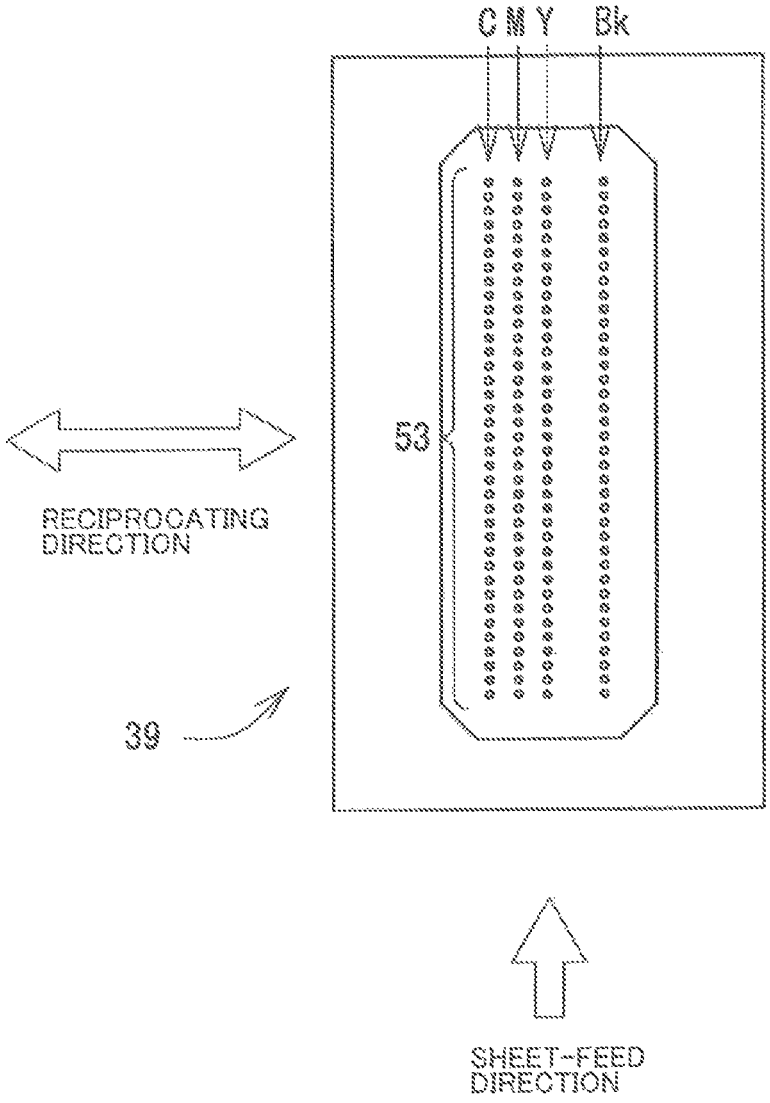
FIG. 5 is a bottom view showing a lower surface (a nozzle-open surface) of an ink-jet recording head of the MFD.
Figure 6:
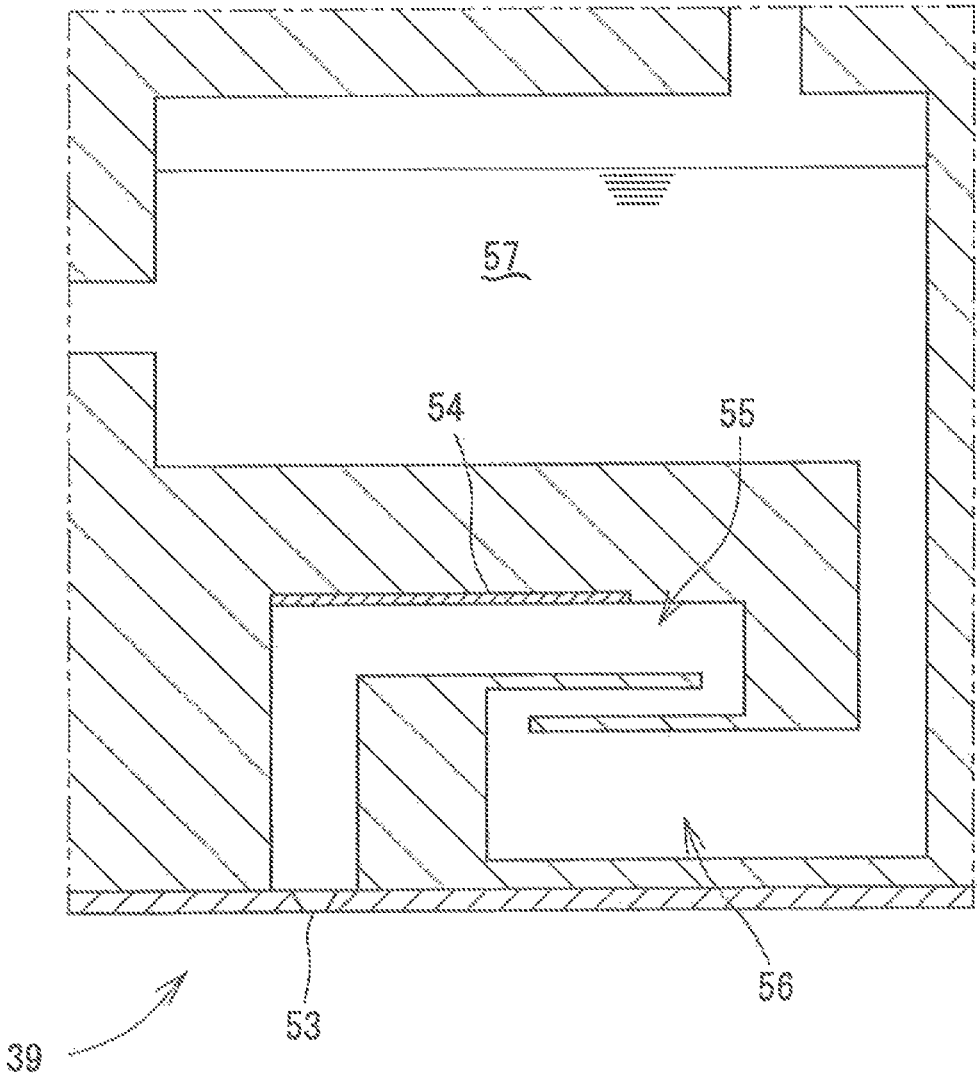
FIG. 6 is an illustrative view schematically showing a cross-section structure of the ink-jet recording head.

FIG. 5 shows a lower surface of the ink-jet recording head 39 where four groups of ink ejection nozzles 53 respectively corresponding to the four inks, CMYK, open in a downward direction. The ink ejection nozzles 53 of each group are arranged in an array in the sheet-feed direction. The vertical direction as seen in FIG. 5 corresponds to the sheet-feed direction, while the horizontal direction as seen in FIG. 5 corresponds to the reciprocating direction of the carriage 38. Thus, four arrays of ink ejection nozzles 53 corresponding to the cyan ink C, the magenta ink M, the yellow ink Y, and the black ink K are provided, in the order of description, in a direction from the left-hand side of the head 39 toward the right-hand side thereof in FIG. 5. In each array, the ink ejection nozzles 53 are provided at an appropriate pitch. However, the pitch of provision of the nozzles 53 in each array and/or the total number of the nozzles 53 provided in the each array may be changed, as needed, depending upon, e.g., a resolution of images recorded by the printer portion 2. In addition, the total number of the arrays of the ink ejection nozzles 53 may be changed depending upon the total number of the inks used in the MFD 1.

The four inks supplied from the four ink cartridges via the respective ink-supply tubes 41 flow through ink-supply passages into four cavities 55 via four buffer tanks 57 and four manifolds 56, respectively. The four inks C, M, Y, K supplied via the ink-supply passages are injected as droplets of ink from the nozzles 53 toward the recording sheets by a deformation of piezoelectric elements 54.

As shown in FIG. 3, a convey roller 60 and a pinch roller 61 are provided on the upstream side of the image recording portion 24. The convey roller 60 and the pinch roller 61 cooperate with each other to nip the recording sheet supplied along the sheet-feed path 23. When the convey roller 60 is rotated, the recording sheet is supplied downstream along the sheet-feed path 23, and is placed on the platen 42. The convey roller 60 is intermittently driven or rotated by the LF motor 71 so as to feed the recording sheet, with an amount of each intermittent motion of the recording sheet corresponding to an amount of line feed. A sheet-discharging roller 62 and a rowel or spur roller 63 are provided on a downstream side of the image recording portion 24. The sheet-discharging roller 62 and the spur roller 63 cooperate with each other to nip the recording sheet to which the droplets of inks have been applied and to convey the recording sheet onto the sheet-discharging tray 21. The sheet-discharging roller 62 is intermittently driven or rotated by the LF motor 71 so as to feed the recording sheet, with an amount of each intermittent motion of the recording sheet corresponding to the amount of line feed. The convey roller 60 is rotated in synchronism with the sheet-discharging roller 62. A rotary encoder 76 (shown in FIG. 7) provided on the convey roller 60 includes a photo sensor or an optical sensor that detects slits or patterns of an encoder disc which rotates along with the convey roller 60 and produces pulse signals corresponding to the detected slits. The rotation of the convey roller 60 and the sheet-discharging roller 62 are controlled based on the pulse signals.

The pinch roller 61 is provided to be slidable in a direction toward and away from the convey roller 60 and is elastically biased toward the convey roller 60 so as to press, with an appropriate pressing force, the same 60. Therefore, when the convey roller 60 and the pinch roller 61 cooperate with each other to nip the recording sheet, the pinch roller 61 is elastically retracted by an amount corresponding to the thickness of the recording sheet. Thus, the rotating force of the convey roller 60 is reliably transmitted to the recording sheet. This is true with the sheet-discharging roller 62 and the spur roller 63. In the present embodiment, however, the spur roller 63 presses the recording sheet on which the image has been recorded. Therefore, in order to prevent the deterioration of the image recorded on the recording sheet, the spur roller 63 has a plurality of sharp projections along an outer circumferential surface thereof.

Referring next to the block diagram of FIG. 7, a control portion 64 is for controlling various operations of the MFD 1 including not only the printer portion 2 but the scanner portion 3. Since the scanner portion 3 is not a major component to which the present invention is applied, detailed description thereof is omitted. The control portion 64 constitutes a microcomputer mainly including a CPU (Central Processing Unit) 65, a ROM (Read Only Memory) 66, a RAM (Random Access Memory) 67, an EEPROM (Electrically Erasable and Programmable ROM) 68. The control portion 64 is connected to an ASIC (Application Specific Integrated Circuit) through a bus line 69.

The ASIC 70 is operable to control the rotation of the LF motor 71 by generating a signal fed to the LF motor 71 according to a command from CPU 65. The signal is fed to a drive circuit 72, and then a drive signal is fed to the LF motor 71 from the drive circuit 72.

The drive circuit 72 is arranged to drive the LF motor 71 connected to the sheet-feed roller 25, the convey roller 60 and the sheet-discharging roller 62 and generate an electric signal for rotating the LF motor 71 when an output signal from the ASIC 70 is received. The LF motor 71 is rotated when the electric signal is received and the rotating force of the LF motor 71 is transmitted to the sheet-feed roller 25, the convey roller 60 and the sheet-discharging roller 62 via a well-known drive device including a gear and a drive shaft.

The ASIC 70 is operable to control the rotation of the CR motor 73 by generating a signal fed to the CR motor 73 according to a command from CPU 65. The signal is fed to a drive circuit 74, and then a drive signal is fed to the CR motor 73 from the drive circuit 74. The carriage 38 is reciprocated when the rotating force of the CR motor 73 is transmitted to the carriage 38 via the carriage drive device 46. As described above, the reciprocating movement of the carriage 38 is controlled by the control portion 64.

A drive circuit 75 is for selectively injecting ink from the ink-jet recording head 39 toward the recording sheet at a predetermined timing. The drive circuit 75 receives an output signal generated in the ASIC 70 based on a drive control signal outputted from the CPU 65 so as to drive and control the recording head 39. The drive circuit 75 is mounted on the head control board 83.

The rotary encoder 76 and the linear encoder 77 are connected to the ASIC 70. The rotary encoder 76 is arranged to detect an amount of the rotation of the convey roller 60, and the linear encoder 77 is arranged to detect a position of the carriage 38 in the widthwise direction of the MFD 1. When a power of the MFD 1 is on, the carriage is moved to one of opposite ends of each of the guide rails 43, 44 in the widthwise direction of MFD 1, so that a position detected by the linear encoder 77 is initialized. When the carriage 38 is moved on the guide rails 43, 44 in the widthwise direction from the initial position, the sensible portions of the encoder strip 50 is sensed by the optical sensor 35 disposed on the carriage 38, and the number of pulse signals based on the sensing of the sensible portions by the sensor 35 is fed to the control portion 64 as an amount of the movement of the carriage 38. Based on the amount of the movement of the carriage 38, the control portion 64 controls the rotation of the CR motor 73 so as to control the reciprocating movement of the carriage 38.

As shown in FIG. 4, the control portion 64 constitutes a main board 82. Signals for the image recording and so on are transmitted to the head control board 83 of the recording head 39 from the main board 82 through a flat cable 85. The flat cable 85 has a flat belt-like shape, and includes a plurality of conductors and an insulating film formed of a synthetic resin such as a polyester film and covering the conductors. The main board 82 is electrically connected to the head control board 83 through the flat cable 85. The flat cable 85 extends at one end portion thereof from the carriage 38 in a way in which a front and a rear surfaces of the belt-like shape thereof are opposed to the sheet-feed direction. The flat cable 85 is curved in a generally U-shape in its plan view or as seen in a vertical direction in a space inside of the ink-supply tubes 41 and fixed to the frame of MFD 1 by a fixing clip 86. The other end portion of the flat cable 85 extends from the fixing clip 86 and is attached or fixed to the main board 82. Since a curved portion of the flat cable 85 is not fixed to any members, the flat cable 85 can be changed in its curved shape so as to follow the reciprocating movement of the carriage 38, similarly to the ink-supply tubes 41.

Referring next to FIG. 8, there will be described a positional relation ship between the carriage 38, the ink-supply tubes 41, the pair of guide rails 43, 44 and the encoder strip 50, which is established in the MFD 1. In FIG. 8, an upper cover member of the carriage 38 is removed so that the head control board 83 is exposed outside. In FIG. 8, the support portion 33 of the guide rail 44 is not shown, and the ink-supply tubes 41 and the flat cable 85 are partially omitted in the illustration.

As shown in FIG. 8, the guide rails 43, 44 have the respective slide surfaces 92, 93. The slide surfaces 92, 93 consist of respective upper surfaces of the guide rails 43, 44 which are disposed at respective downstream portions of the guide rails 43, 44 in the sheet-feed direction and each of which extends in parallel with the widthwise direction of the MFD 1. The carriage 38 is supported at the slide portions 90, 91 thereof or respective end portions thereof in the sheet-feed direction by the slide surfaces 92, 93 of the guide rails 43, 44. The carriage 38 is slidable on the slide surfaces 92, 93 in the widthwise direction, but the slide surfaces 92, 93 are not for preventing the carriage 38 from moving in the sheet-feed direction. That is, the carriage 38 would be movable in the sheet-feed direction relative to the slide surfaces 92, 93, without the engaged portion 45 of the guide rail 44.

As mentioned above, the guide rail 44 has the engaged portion 45 on the upstream edge portion thereof in the sheet-feed direction. The engaged portion 45 extends in the widthwise direction and has a vertical surface as an engaged surface which extend in the reciprocating direction of the carriage 38 or in the widthwise direction. The carriage 38 includes the engaging portion 94 which engages the engaged portion 45 so as to be movable in the widthwise direction and unmovable in the sheet-feed direction relative to the guide rails 43, 44. The engaged portion 45 is located between the slide surfaces 92, 93 in the sheet-feed direction as seen in the vertical direction. The engaged portion 45 and the engaging portion 94 have dimensions each lying within respective predetermined tolerances for providing a play between the engaging portion 94 and the engaged portion 45, which play facilitates an assembling of the carriage 38 and a smooth sliding of the carriage 38. Therefore, while the engaging portion 94 engages the engaged portion 45, the carriage 38 tends to rotate in the horizontal direction about an axis and to accordingly change its posture, due to presence of the above-described play. The rotary axis passes the engaged portion 45 and extends in the vertical direction. If the engaged portion 45 were located outside of the slide surfaces 92, 93 in the sheet-feed direction, at least one of respective distances between the engaged portion 45 and the slide surfaces 92, 93 in the sheet-feed direction could be larger than those of the present embodiment. Accordingly, at least a distance between the engaged portion 45 and the end portion of the carriage 38 supported by one of the slide surfaces 92, 93 which is more distanced from the engaged portion 45 in the sheet-feed direction could be larger compared to the present embodiment, so that the end portion of the carriage 38 more distanced from the engaged portion 45 would be more moved in the widthwise direction (in the lengthwise direction of the slide surfaces 92, 93) resulted from the rotation of the carriage 38 in the horizontal direction, causing the recorded image to be poor in quality or defective. In the present embodiment, the engaged portion 45 is located between the slide surfaces 92, 93, so that the carriage 38 can reciprocate with high stability, leading to improving the quality of images recorded on each recording sheet.

As shown in FIG. 8, the encoder strip 50 is supported by the support portions 33, 34 which stand from the respective end portions of the guide rail 44 in the lengthwise direction of the guide rail 44 or in the widthwise direction of the MFD 1. Two engaging holes 87 are formed on both lengthwise ends of the encoder strip 50. Each of the support portions 33, 34 includes a hook portion extending toward the encoder strip 50 in the horizontal direction. Each hook portion is inserted into the respective one of the engaging holes 87 so that the encoder strip 50 is supported at the lengthwise ends thereof by the support portions 33, 34. The encoder strip 50 is located between the slide surfaces 92, 93 of the guide rails 43, 44 in the sheet-feed direction. As described above, the carriage 38 tends to rotate about the axis due to the tolerance with respect to the dimensions of the engaging portion 94. If the encoder strip 50 were located outside of the slide surfaces 92, 93 in the sheet-feed direction, a distance between the engaged portion 45 and the encoder strip 50 in the sheet-feed direction could be larger than that of the present embodiment. Accordingly, a portion of the carriage 38 by which the encoder strip 50 is detected would be more rotated compared to the present embodiment, causing the accuracy of the position detection of the carriage 38 by the linear encoder 77 to be lowered. Therefore, since the encoder strip 50 is located between the slide surfaces 92, 93 in the present embodiment, the position of the carriage is detected with high accuracy by the linear encoder 77 and the carriage 38 can be controlled with high stability.

It is preferable that the engaged portion 45 and the encoder strip 50 are aligned with a center of gravity of the carriage 38 as seen in the vertical direction. The engaged portion 45 and the encoder strip 50 may be slightly offset from the center of gravity of the carriage 38 as seen in the vertical direction. In such an offset arrangement, the offset amount (by which the engaged portion 45 or the encoder strip 50 is offset from the center of gravity of the carriage 38) is preferably less than 20% of the distance between the two guide rails 43, 44 in the sheet-feed direction (i.e., a distance between centers of the respective slide surfaces 92, 93 as measured in the sheet-feed direction), more preferably less than 10% or 5% thereof. Since the engaged portion 45 and the encoder strip 50 are substantially aligned with the center of gravity of the carriage 38 as seen in the vertical direction, the engaged portion 45 and the encoder strip 50 are free of the influence caused by the rotation of the carriage 38, so that the carriage 38 can reciprocate with high stability.

The above discussion can be applied to a relationship between a line of action of a drive force by the carriage drive device 46 and the center of gravity of the carriage 38, as described below. The carriage 38 reciprocates on the two guide rails 43, 44 when the timing belt 49 of the carriage drive device 46 applies a drive force to the carriage 38 so as to reciprocate the carriage 38 in the widthwise direction, such that the applied drive force acts on the carriage 38 along a line of action that is aligned with the center of gravity of the carriage 38 as seen in the vertical direction. If the line of action (corresponding to a position where one of the linear portions 96 of the timing belt 49 is attached to the carriage 38) is offset from the center of gravity of the carriage 38, the carriage 38 can be rotated about the center of gravity by receiving a rotary moment from the timing belt 49. The center of gravity of the carriage 38 is a position least influenced by the rotation of the carriage 38. It is common that at least one of the engaged portion 45 and the timing belt 49 should be offset from the center of gravity of the carriage 38 for avoiding interference of the engaged portion 45 with the timing belt 49. In the present embodiment, the engaged portion 45 is slightly offset from the center of gravity of the carriage 38.

As shown in FIG. 4, the space within which the U-shape of each ink-supply tube 41 is changeable is located to overlap with the guide rails 43, 44 and the encoder strip 50 as seen in the third direction. As the carriage 38 is moved toward one end (a right-hand side in FIG. 4) in the widthwise direction of the MFD 1, the curved portion 104 of the ink-supply tube 41 is bent such that the radius of curvature thereof becomes larger than that in a state which is shown in FIG. 4. In this instance, actually, the arm portions 102 are caused to protrude toward the rear side of the MFD 1 (an upward side in FIG. 4) as the radius of curvature of each curved portion 104 becomes larger by the reciprocating movement of the carriage 38, because the ink-supply tubes 41 are prevented from protruding toward the front side of the MFD 1 (a downward side in FIG. 4) by the guide wall 37. The protruded portions of the arm portions 102 (corresponding to a part of the ink-supply tube) are aligned with the engaged portion 45 and the encoder strip 50 in the vertical direction and protrude above the platen 42. Thus, the MFD 1 can enjoy a reduced size, compared to a case in which the space for accommodating the protruded portion of the arm portions 102 is located somewhere else where the guide rails 43, 44 and the encoder strip 50 are not disposed as seen in the third direction.

As shown in FIG. 8, the engaged portion 45, the encoder strip 50, and the ink-supply tubes 41 are located on the downstream portion as one end portion with respect to a center of the carriage 38 in the sheet-feed direction. That is, the engaged portion 45, the encoder strip 50 and the ink-supply tubes 41 are offset from the center of the carriage 38 in the sheet-feed direction at least when the carriage 38 is positioned in the left end position as seen in FIG. 4, namely, at least when any portion of each ink-supply tube 41 is not substantially located on a rear side of the attached portion of the carriage 38 (to which the ink-supply tube 41 is connected). Thus, a space on the upstream portion in the sheet-feed direction can be downsized, leading to a reduction in the overall size of the MFD 1. Also, since the engaged portion 45, the encoder strip 50, and the ink-supply tubes 41 are located on the same end portion in the sheet-feed direction, these members may be close to each other. However, as discussed below, the encoder strip 50 and the engaged portion 45 are arranged on an upper side and a lower side, respectively, with respect to the carriage 38 so as not to contact with each other. Also, the ink-supply tubes 41, the engaged portion 45 and the encoder strip 50 are separated in the vertical direction so as not to contact with each other. In a case in which the engaged portion 45, the encoder strip 50, and the ink-supply tubes 41 are located on the upstream portion as the other end portion with respect to the center of the carriage 38 in the sheet-feed direction, the MFD 1 can enjoy the same effect mentioned above.

As shown in FIG. 8, the engaged portion 45 of the guide rail 44 is located below the carriage 38, and the encoder strip 50 is located above the carriage 38. That is, the pair of guide rails 43, 44 are located on one of opposite sides of the carriage 38 in the vertical direction, while the encoder strip 50 is located on the other of the opposite sides of the carriage 38 in the vertical direction. As described above, the lubricant such as grease is spread on the engaged portion 45 for a smooth sliding of the carriage 38. The encoder strip 50 is elastically supported by the support portions 33, 34 so as to be bent appropriately when an external force is applied thereto. For example, in the event that sheets are jammed on the platen 42, when an operator put his/her hands into a space between the two guide rails 43, 44 for removing the jammed sheets, the operator may contact the encoder strip 50. When the external force is applied from the operator to the encoder strip 50, the encoder strip 50 may be bent so as to contact the engaged portion 45. This causes the encoder strip 50 to be soiled with the lubricant on the engaged portion 45, whereby the sensible portions could become undetectable by the optical sensor 35. In the present embodiment, since the engaged portion 45 is located below the carriage 38 and the encoder strip 50 is located above the same 38, the engaged portion 45 and the encoder strip 50 are physically isolated by the carriage 38 from each other in the vertical direction, so that the encoder strip 50 does not contact the engaged portion 45 even when the encoder strip 50 is bent. Therefore, the carriage 38 is prevented from being uncontrolled because the encoder strip 50 becomes undetectable, and can be controlled to reciprocate with high stability.

As shown in FIG. 8, the four ink-supply tubes 41 are located within a space between the pair of guide rails 43, 44 and the encoder strip 50 in the vertical direction. Each ink-supply tube 41 has the curved shape that is changeable in the space by the reciprocating movement of the carriage 38, without any portion of said ink-supply tube 41 being excluded from said space. In other words, the encoder strip 50, the ink-supply tubes 41, and the engaged portion 45 are arranged in this order as seen in the downward direction, such that the encoder strip 50, the ink-supply tubes 41 and the engaged portion 45 do not interfere with each other. As described above, the curved shape of each ink-supply tube 41 is changed so as to follow the reciprocating movement of the carriage 38. In this instance, a part of each ink-supply tube 41 is caused to protrude in the horizontal direction, so as to be aligned or overlap with the engaged portion 45 and the encoder strip 50 in the vertical direction. The protruding portions of the respective arm portions 102 are located between the engaged portion 45 and the encoder strip 50 in the vertical direction without contacting the engaged portion 45 and the encoder strip 50. This arrangement is effective to prevent the lubricant (applied onto the slide surfaces 92, 93 of the guide rails 43, 44 and the engaged portion 45) from being stuck to the encoder strip 50 via the ink-supply tubes 41. Therefore, the carriage 38 is prevented from being uncontrolled because the encoder strip 50 becomes undetectable, and can be controlled to reciprocate with high stability.

As described above, the engaged portion 45 and the encoder strip 50 are physically separated by the carriage 38 from each other in the vertical direction. Thus, there is provided a space corresponding to a height of the carriage 38 between the engaged portion 45 and the encoder strip 50. Since the ink-supply tubes 41 are disposed such that their protruding portions can protrude into said space, the space can be utilized effectively, leading to reduction in the vertical size of the MFD 1.

As shown in FIG. 8, the optical sensor 35, which senses the sensible portions of the encoder strip 50, is fixed directly to the head control board 83 and projects from the carriage 38 upward or in a direction away from the guide rails 43, 44 in the vertical direction. Since the optical sensor 35 is fixed directly to the head control board 83, there is no need for a wiring between the optical sensor 35 and the head control board 83. Further, when the head control board 83 is attached to the carriage 38, the optical sensor 35 is simultaneously attached to the carriage 38, leading to reduction in the production cost of the MFD 1.

In the present embodiment, the pair of guide rails 43, 44 are distant from each other in the sheet-feed direction. That is, although it is preferable that the two guide rails 43, 44 are distant from each other exactly in the sheet-feed direction, the guide rails 43, 44 may be distant from each other in a direction that is slightly inclined to the sheet-feed direction, so that the guide rails 43, 44 cooperate with each other to constitute a so-called slant-type guide device. In other words, the guide rails 43, 44 may be distant from each other in the vertical direction as well as in the horizontal direction, as long as a distance therebetween as measured in the horizontal direction is larger than that as measured in the vertical direction. Where the guide rails 43, 44 constitute the slant-type guide device, an angle of the inclination is preferably less than 15 degrees, more preferably less than 10 degrees or 5 degrees.

In the present embodiment, the pair of guide rails 43, 44 are described as the pair of guide members corresponding to the guide device. Instead of the guide rails 43, 44, for example, the guide device may include a guide shaft and a guide rail as the guide members to support the carriage 38 and to guide the reciprocating movement of the carriage 38. In this case, the guide shaft may be arranged above or below the carriage 38, or arranged so as to penetrate through the carriage 38. In either of the arrangements of the guide shaft with respect to the carriage 38, the carriage 38 is located between the guide shaft and the encoder strip 50 disposed above or below the carriage 38 in the vertical direction. That is, the guide shaft and the guide rail are located on one of opposite sides of the carriage 38 in the vertical direction, while the encoder strip 50 is located on the other of opposite sides of the carriage 38 in the vertical direction.

It is to be understood that the present invention may be embodied with various changes, modifications, and improvements that may occur to a person skilled in the art without departing from the spirit and scope of the invention defined in the appended claims.

What is claimed is:

1. An image recording apparatus, comprising:

a plate member which extends in a first direction that is a substantially horizontal direction, the plate member including a base portion to which a pulley is mounted and a first guide extending in the first direction;

a second guide which extends in the first direction;

a carriage which is reciprocateable and slidable with respect to the first guide and the second guide in the first direction, while being supported and guided by the first guide and the second guide;

a timing belt which is wound on the pulley and which is connected to the carriage;

a recording head which is carried by the carriage, and which ejects droplets of ink toward a recording medium so as to record an image thereon;

a carriage movement detector including (a) a sensor which is carried by and mounted on the carriage and (b) an encoder strip which extends in the first direction, the carriage movement detector detecting a movement of the carriage in the first direction;

a support plate including a narrow upper-end plate portion and a wide lower-end plate portion, the support plate standing from a surface of the base portion of the plate member at the wide lower-end plate portion and configured to support the encoder strip at a position higher than the first guide of the plate member at the narrow upper-end plate portion, the narrow upper-end plate portion having a hook portion extending from the narrow upper-end plate portion and inserted into a hole of the encoder strip in a second direction to hold the encoder strip standing relative to the base portion of the plate member, a width of the wide lower-end plate portion in the second direction being greater than that of the narrow upper-end plate portion, the second direction being perpendicular to the first direction and a vertical direction, the narrow upper-end plate portion being located at an uppermost end of the support plate, the wide lower-end plate portion being located at a lowermost end of the support plate, wherein the base portion of the plate member has a horizontal surface facing upward, the timing belt is interposed between the encoder strip and the horizontal surface of the plate member, and the carriage reciprocates in the first direction in a state in which a part of the carriage is interposed in the vertical direction between the horizontal surface of the base portion of the plate member and the encoder strip, no part of the carriage is located right above the encoder strip and a control board mounted on the carriage is interposed in the vertical direction between the horizontal surface of the base potion of the plate member and the encoder strip standing relative to the base portion of the plate member.

2. The image recording apparatus according to claim 1, wherein the first guide is located on a first side of the carriage, and wherein the encoder strip is located on a second side of the carriage, wherein the second side of the carriage is opposite the first side of the carriage in the vertical direction.

3. The image recording apparatus according to claim 1, wherein the encoder strip is substantially aligned with a center of gravity of the carriage as seen in the vertical direction.

4. The image recording apparatus according to claim 1, wherein the sensor is fixed directly to a control board which controls the recording head.

5. The image recording apparatus according to claim 1, wherein the encoder strip is located above the carriage, and the first guide is located below the carriage.

6. The image recording apparatus according to claim 5, wherein the sensor is fixed directly to a control board which controls the recording head and projects from the control board in a direction away from the first guide in the vertical direction.

7. The image recording apparatus according to claim 1, wherein the first guide and the second guide are spaced apart from each other in the second direction perpendicular to the first direction and the vertical direction.

8. The image recording apparatus according to claim 1, wherein a length of the plate member in the first direction is larger than a length of a range of a reciprocating movement of the carriage in the first direction.

9. The image recording apparatus according to claim 1, wherein the support plate stands from the horizontal surface of the base portion, and an upper end of a guide rail standing from the horizontal surface of the base portion is interposed between the horizontal surface of the base portion and the encoder strip in the vertical direction.

10. The image recording apparatus according to claim 1, wherein the support plate is located adjacent to the pulley and located at a position nearer to a distal end of the first guide in the first direction than a position to which the pulley is mounted.

* * * * *